US007071448B1

(12) United States Patent
Kim et al.

(10) Patent No.: US 7,071,448 B1
(45) Date of Patent: Jul. 4, 2006

(54) COOKING CHAMBER PARTITION MEMBER AND ELECTRIC OVEN HAVING THE SAME

(75) Inventors: Kyoung Ho Kim, Suwon-si (KR); Cheol Jin Kim, Suwon-si (KR); Sung Soo Park, Hwaseong-si (KR); Kil Young Lee, Suwon-si (KR); Suk Yoon Yum, Seoul (KR); Sung Wook Kang, Seoul (KR)

(73) Assignee: Samsung Electronics Co., Ltd., Gyeonggi-Do (KR)

( * ) Notice: Subject to any disclaimer, the term of this patent is extended or adjusted under 35 U.S.C. 154(b) by 0 days.

(21) Appl. No.: 11/135,643

(22) Filed: May 24, 2005

(30) Foreign Application Priority Data

Dec. 17, 2004 (KR) ..... 10-2004-108211

(51) Int. Cl.
*A21B 1/50* (2006.01)
*A21B 3/00* (2006.01)
*F24C 15/16* (2006.01)

(52) U.S. Cl. ..... 219/394; 219/400; 126/333; 126/339; 248/250

(58) Field of Classification Search ..... 219/394
See application file for complete search history.

(56) References Cited

U.S. PATENT DOCUMENTS 2,251,600 A * 8/1941 Pollock ..... 108/59
2,994,760 A * 8/1961 Pecoraro et al. ..... 219/394
4,780,597 A * 10/1988 Linhart et al. ..... 219/404
5,618,458 A * 4/1997 Thomas ..... 219/394
5,994,673 A * 11/1999 El-Shoubary et al. ..... 219/403
6,545,251 B1 * 4/2003 Allera et al. ..... 219/394
2002/0060215 A1 5/2002 Alera et al.
2003/0047553 A1 3/2003 Patti et al.
2005/0120689 A1 * 6/2005 Kentner et al. ..... 55/507

FOREIGN PATENT DOCUMENTS

| | | |
|---|---|---|
| FR | 2 848 289 A1 | 6/2004 |
| JP | 53-014440 | 9/1978 |
| JP | 62-297634 | 12/1987 |
| JP | 09-289863 | 11/1997 |
| JP | 10-122576 | 5/1998 |
| KR | 20-1998-0001806 A | 2/1988 |
| KR | 10-1993-0014230 A | 7/1993 |
| KR | 20-2000-0013161 Y1 | 5/2000 |

* cited by examiner

*Primary Examiner*—Joseph Pelham
(74) *Attorney, Agent, or Firm*—Sughrue Mion, PLLC

(57) ABSTRACT

An electric oven includes a partition member to partition a cooking chamber into two cooking regions. The partition member for use in the electric oven includes an insulating board interposed between upper and lower plates of the partition member, and a shock-absorbing unit to prevent damage to the insulating board. Using the electric oven configured as stated above, it is possible to intercept heat transfer between the partitioned respective cooking regions, thereby preventing heat loss between the respective cooking regions and damage to the interior of the partition member.

14 Claims, 3 Drawing Sheets

COOKING CHAMBER PARTITION MEMBER AND ELECTRIC OVEN HAVING THE SAME

CROSS-REFERENCE TO RELATED APPLICATION

This application claims priority from Korean Patent Application No. 2004-108211, filed on Dec. 17, 2004 in the Korean Intellectual Property Office, the disclosure of which is incorporated herein by reference.

BACKGROUND OF THE INVENTION

1. Field of the Invention

The present invention relates to a partition member of a cooking chamber and an electric oven having the same and, more particularly, to a partition member included in an electric oven to partition a cooking chamber of the oven into upper and lower cooking regions, thereby enabling independent use of respective partitioned cooking regions.

2. Description of the Related Art

An electric oven is an appliance used for baking or roasting food by circulating air around heaters into a cooking chamber. The electric oven comprises a cooking chamber to accommodate food to be cooked, a heater to generate heat, and a fan to circulate air around the heater into the cooking chamber. If necessary, upper and lower grill heaters may be selectively arranged at upper and lower portions of the cooking chamber to apply radiant heat to the food placed in the cooking chamber.

Generally, the conventional electric oven cannot simultaneously cook two or more different kinds of food because it is equipped with one cooking chamber, one heater and one fan. Such conventional electric oven is inefficient because the electric oven must be operated with the entire capacity thereof even when a small amount of food is cooked.

In order to eliminate the above drawback, an electric oven for cooking two kinds of food at different temperatures, respectively, has been proposed, as disclosed in Japanese Patent Laid-open Publication No. Heisei 09-303791. This electric oven includes two fans vertically arranged in rear of the cooking chamber, in order to implement a cooking system in which the amounts of hot air respectively applied to different kinds of food located in upper and lower cooking regions are different.

However, using the disclosed electric oven, a rack to divide the cooking chamber into the upper and lower cooking regions has no function to intercept heat transfer between the divided cooking regions, inevitably causing the transfer of heat generated in one of the cooking regions to the other cooking region. This makes it difficult to cook different food items placed in the respective cooking regions at appropriately determined different temperatures, and results in heat loss between the cooking regions when only one of the cooking regions is used to cook food.

SUMMARY OF THE INVENTION

Therefore, the present invention has been made in order to solve the above problems, and it is an aspect of the invention to provide a partition member to partition a cooking chamber into two cooking regions and an electric oven having the same, which can intercept heat transfer between the respective partitioned cooking regions to thereby allow different food items placed in the respective cooking regions to be cooked at appropriately determined different temperatures, and can prevent heat loss between the cooking regions.

It is another aspect of the invention to provide a partition member to partition a cooking chamber into two cooking regions and an electric oven having the same, which can prevent damage to the partition member, resulting in a high structural reliability thereof.

Additional aspects and/or advantages of the invention will be set forth in part in the description which follows and, in part, will be apparent from the description, or may be learned by practice of the invention.

In accordance with one aspect, the present invention provides a partition member to partition a cooking chamber of an electric oven into two cooking regions, comprising: an insulating board to intercept heat transfer between the partitioned respective cooking regions; and a shock-absorbing unit to elastically support the insulating board in order to prevent damage to the insulating board.

The shock-absorbing unit may include springs to elastically support upper and lower portions of the insulating board.

The shock-absorbing unit may further include a holder to supportably surround an edge of the insulating board, and the springs may be disposed at upper and lower sides of the holder.

An elastic cushion may be interposed between the insulating board and the holder.

The partition member may further comprise: at least one auxiliary insulator provided at one or both of the upper and lower sides of the insulating board.

In accordance with another aspect, the present invention provides an electric oven comprising: a cooking chamber for accommodating food to be cooked; a partition member to partition the cooking chamber into two cooking regions; an insulating board incorporated in the partition member to intercept heat transfer between the partitioned respective cooking regions; and a shock-absorbing unit incorporated in the partition member to elastically support the insulating board in order to prevent damage to the insulating board.

The partition member may include upper and lower plates spaced apart from each other by a predetermined distance, and the insulating board may be interposed between the upper and lower plates.

The shock-absorbing unit may include springs to support upper and lower sides of the insulating board.

The shock-absorbing unit may further include a holder surrounding an edge of the insulating board, and the springs may be disposed between the upper plate and the holder and between the lower plate and the holder.

An elastic cushion may be interposed between the insulating board and the holder.

The partition member may further include at least one auxiliary insulator provided at one or both of the upper and lower sides of the insulating board.

The partition member may be detachably mounted in the cooking chamber.

The electric oven may further comprise: a plurality of convection modules adapted to heat the partitioned respective cooking regions in an individual fashion.

BRIEF DESCRIPTION OF THE DRAWINGS

These and/or other aspects and advantages of the invention will become apparent and more readily appreciated from the following description of the exemplary embodiments, taken in conjunction with the accompanying drawings, in which.

Figure 1:
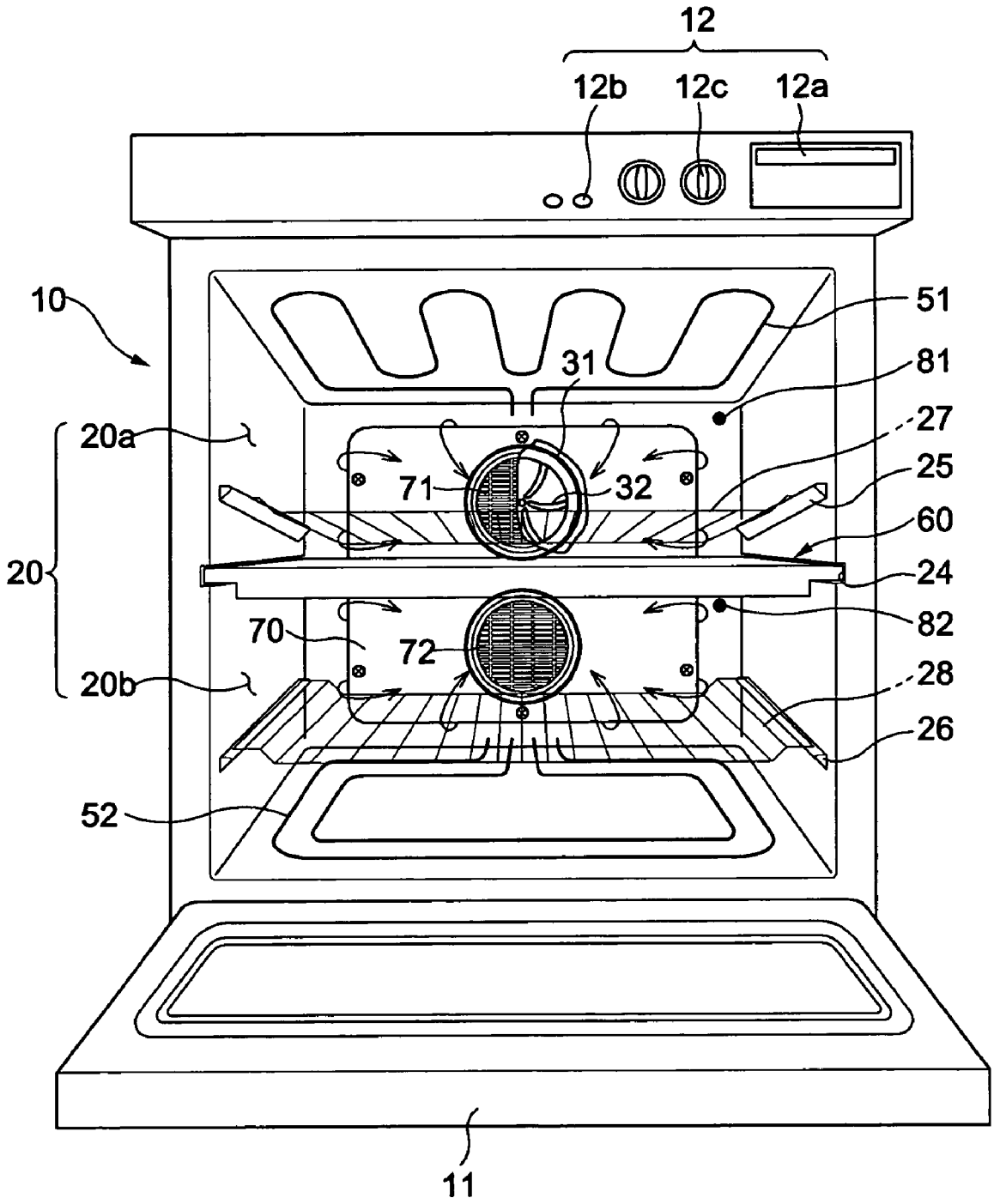
FIG. 1 is a front view showing an electric oven according to an exemplary embodiment of the present invention.

DETAILED DESCRIPTION OF THE ILLUSTRATIVE, NON-LIMITING EMBODIMENTS OF THE INVENTION

Reference will now be made in detail to an illustrative, non-limiting embodiment of the present invention, examples of which are illustrated in the accompanying drawings, wherein like reference numerals refer to like elements throughout. The exemplary embodiment is described below to explain the present invention by referring to the figures.

Figure 2:
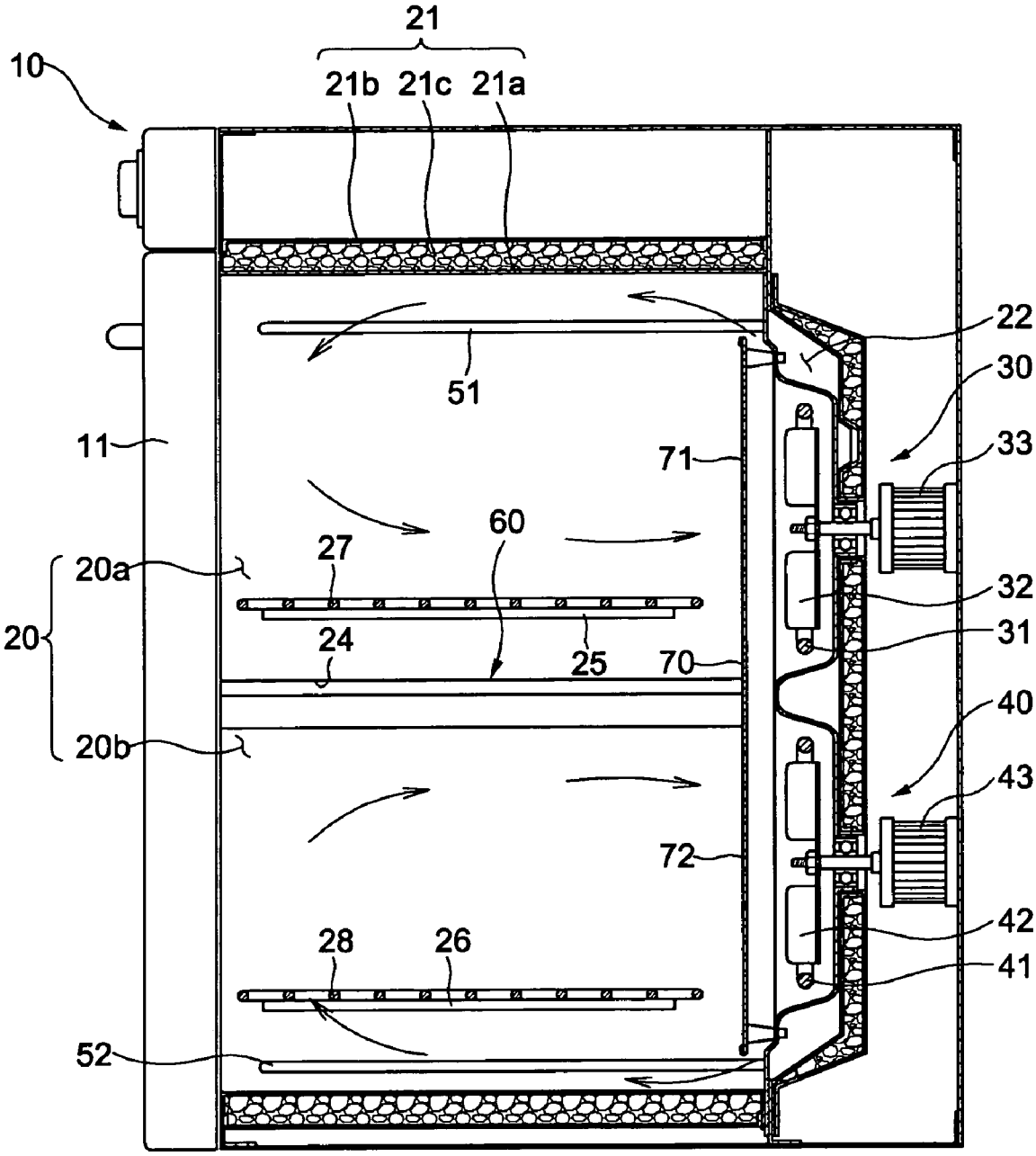
FIG. 2 is a side sectional view of the electric oven shown in FIG. 1.

FIGS. 1 and 2 are views illustrating an electric oven according to an exemplary embodiment of the present invention. As shown in FIGS. 1 and 2, the electric oven comprises a case 10 defining the appearance of the electric oven, a cooking chamber 20 defined in the interior of the case 10, and first and second convection modules 30 and 40 respectively installed at upper and lower positions in the rear of the cooking chamber 20 to apply hot air to food placed in the cooking chamber 20; that is, to cook the food in accordance with a convection heating operation thereof.

The cooking chamber 20 has an opening at a front end thereof, and the case 10 has an opening at a front wall thereof, in order to allow the user to put food into the cooking chamber 20 through the openings. A door 11 is hingably coupled to a lower end of the front wall of the case 10 such that it is vertically hingable to open and close the openings. An operating panel 12 is mounted to the front wall of the case 10 over the door 11. The operating panel 12 includes a display 12*a* for displaying an operating state of the electric oven, operating buttons 12*b*, and operating switches 12*c*.

The cooking chamber 20 is defined by a cooking chamber wall 21 in the case 10. The cooking chamber wall 21 is inwardly spaced apart from the case 10. The cooking chamber wall 21 has a double wall structure including an inner wall 21*a* and an outer wall 21*b*. An insulator 21*c* is interposed between the inner and outer walls 21*a* and 21*b* to prevent heat in the cooking chamber 20 from being transferred to the outside of the cooking chamber 20.

Upper and lower grill heaters 51 and 52 are arranged at upper and lower portions of the cooking chamber 20 to apply radiant heat to the food placed in the cooking chamber 20; that is, to cook the food in a grill heating operation thereof. A partition member 60 is arranged at a central portion of the cooking chamber 20 such that it vertically partitions the cooking chamber 20 into first and second cooking regions 20*a* and 20*b*. The partition member 60 is detachably mounted in the cooking chamber 20 so as to selectively partition the cooking chamber as occasion demands.

Grill racks 27 and 28 adapted to place food, to be cooked, thereon are arranged in the first and second cooking regions 20*a* and 20*b*, respectively. Guide rails 25 and 26 are provided at the opposite side wall portions of the cooking chamber wall 21 in the first and second cooking regions 20*a* and 20*b*, in order to slidably support the grill racks 27 and 28.

The cooking chamber wall 21 of the cooking chamber 20 is rearwardly recessed at a rear wall portion thereof to define a recess 22. In the recess 22, the first and second convection modules 30 and 40 are installed. Each convection module 30 and 40 includes an annular convection heater 31 and 41, respectively, for generating heat, a convection fan 32 and 42, respectively, for creating a flow of air circulating around the convection heater 31 and 41 and through the cooking chamber 20 to supply the heat from the convection heater 31 and 41 into the cooking chamber 20, and a fan motor 33 and 43 for driving the convection fan 32 and 42, respectively. A hot air cover 70 is arranged in front of the first and second convection modules 30 and 40. The hot air cover 70 is provided with suction grills 71 and 72 respectively adapted to allow air existing in the cooking chamber 20 to be sucked toward the first and second convection modules 30 and 40 therethrough.

The first and second convection modules 30 and 40 are individually controlled such that respective temperatures of the convection heaters 31 and 41 or respective flow rates of air blown by the convection fans 32 and 42 are controlled in an individual fashion. To this end, first and second temperature sensors 81 and 82 are arranged at the first and second cooking regions 20*a* and 20*b* to sense the respective temperatures of the cooking regions 20*a* and 20*b*. Also, a control unit (not shown) is provided to control operations of the first and second convection modules 30 and 40, and the upper and lower grill heaters 51 and 52.

Now, the operation of the electric oven according to the above described embodiment of the present invention will be described.

The electric oven according to the illustrated embodiment of the present invention can provide diverse cooking modes in accordance with diverse kinds or diverse amounts of food, or diverse cooking purposes. Before cooking food, the user should determine, based on the amount and kind of the food to be cooked or different kinds of the food, whether the cooking operation has to be carried out under the condition in which the cooking chamber 20 is partitioned into the first and second cooking regions 20*a* and 20*b* or without being partitioned. Thereafter, the user puts the food into the cooking chamber 20, and then operates the operating panel 12 to operate the electric oven.

Once the electric oven operates, the control unit thereof determines, based on information inputted thereto from the operating panel 12, which ones of the upper and lower grill heaters 51 and 52 and first and second convection modules 30 and 40 have to be operated. In accordance with this determination, the control unit controls the electric oven to carry out a desired cooking operation.

Under the control of the control unit, the upper and lower grill heaters 51 and 52 may generate high-temperature heat which is, in turn, applied to the food in the form of radiant heat, thereby browning the food. Respective convection heaters 31 and 41 of the first and second convection modules 30 and 40 may heat air circulating in accordance with operations of the convection fans 32 and 42, so as to cook the food by the heated air. Respective circulation directions of hot air flows generated by the first and second convection modules 30 and 40 are indicated by arrows in FIGS. 1 and 2.

Where the amount of the food to be cooked is large, the food is cooked under the condition in which both the first and second convection modules 30 and 40 are used without the partition member 60 of the cooking chamber 20. Since the two convection modules 30 and 40 are used in this case, it is possible to cook the food uniformly within a short period of time.

On the other hand, where the amount of the food to be cooked is small, the food is cooked under the condition in which the cooking chamber 20 is partitioned into the first and second cooking regions 20*a* and 20*b* by the partition member 60, and the food is placed in one of the first and second cooking regions 20*a* and 20*b*. In this case, the grill heater 51 or 52 and convection module 30 or 40 corresponding to the other cooking region 20*a* or 20*b* do not operate. Accordingly, it is possible to prevent unnecessary energy consumption, thereby achieving a cooking operation with a high energy efficiency.

Where it is necessary to cook different kinds of food, both the first and second convection modules 30 and 40 are used under the condition in which the different food items are placed in the cooking regions 20*a* and 20*b*, respectively. In order to cook the food items at desired cooking temperatures, which may be different from each other, respectively, the first and second convection modules 30 and 40 are controlled in an individual fashion. Accordingly, the food items may be cooked in the cooking regions 20*a* and 20*b* at different temperatures and/or different flow rates of hot air, respectively, since the cooking regions 20*a* and 20*b* are intercepted in heat transfer by the partition member 60.

Figure 3:
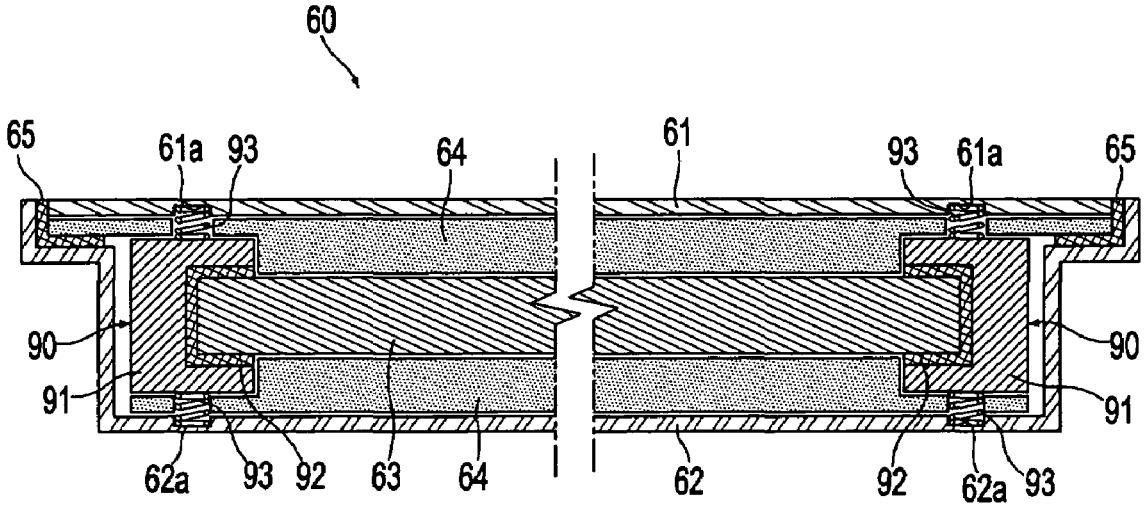
FIG. 3 is a sectional view showing a partition member included in the electric oven according to the exemplary embodiment of the present invention.

Now, the structure of the partition member 60 will be described in more detail with reference to FIG. 3.

The partition member 60 has an upper plate 61 and a lower plate 62 which are spaced apart from each other thereby to define a predetermined volume of interior space therebetween. Both the upper and lower plates 61 and 62 are made of a high-strength, heat-resistant material, such as glass, ceramic, aluminum, etc. Edge bonded portions of the upper and lower plates 61 and 62 are sealed by means of a silicone sealant 65 to prevent permeation of moisture into the interior space of the partition member 60 during washing.

An insulating board 63 is interposed between the upper and lower plates 61 and 62 to intercept heat transfer between the partitioned two cooking regions 20*a* and 20*b*. The insulating board 63 may be formed of a plaster board, but is not exclusively limited thereto, and may be formed of one freely selected from among commonly known various kinds of insulators.

In order to prevent damage to the insulating board 63 when the partition member 60 is attached to or detached from the cooking chamber 20 or when the partition member 60 is transferred, a shock-absorbing unit 90 is provided along the edge of the insulating board 63 to elastically support it. The shock-absorbing unit 90 includes a holder 91 surrounding the edge of the insulating board 63, an elastic cushion 92 inserted between the insulating board 63 and the holder 91, and springs 93 installed to elastically support upper and lower portions of the holder 91. The holder 91 serves to keep the insulating board 63 at a fixed position so as not to fluctuate between the upper and lower plates 61 and 62 and ensure volumetric uniformity in both spaces above and below the insulating board 63. Preferably, but not necessarily, the holder 91 is made of a high-strength, heat-resistant material, such as heat-resistant plastic resin. The cushion 92 is made of an elastic material, such as rubber, and functions to absorb shock to be transmitted from the holder 91 to the insulating board 63. The springs 93 are disposed between the holder 91 and the upper plate 61 and between the holder 91 and the lower plate 62, so as to prevent external shock applied to the upper plate 61 or the lower plate 62 from being directly transmitted to the holder 91. Although the springs 93 shown in FIG. 3 are coil springs, they are substitutable with plate springs, etc. The upper and lower plates 61 and 62 are formed with grooves 61*a* and 62*a* for the installation of the springs 93.

Auxiliary insulators 64 are provided at both upper and lower sides of the insulating board 63 in order to reinforce heat-isolation capability of the insulating board 63 and to prevent damage to upper and lower surfaces of the insulating board 63. The auxiliary insulators 64 are made of, for example, glass fibers, etc. The auxiliary insulators 64 may be provided at only one of the upper and lower sides of the insulating board 63 as occasion demands.

As apparent from the above description, the present invention provides a partition member included in an electric oven to partition a cooking chamber into two cooking regions and incorporating an insulating board to intercept heat transfer between the partitioned respective cooking regions. Using this electric oven, accordingly, it is possible to cook different kinds of food placed in the respective cooking regions at desired different temperatures.

Further, according to the present invention, the partition member incorporates a shock-absorbing unit to elastically support the insulating board, thereby effectively preventing damage to the insulating board due to external shock.

Although an exemplary embodiment of the present invention has been shown and described, it will be appreciated by those skilled in the art that changes may be made in this embodiment without departing from the principles and spirit of the invention, the scope of which is defined in the claims and their equivalents.

What is claimed is:

1. A partition member to partition a cooking chamber of an electric oven into two cooking regions, comprising:

an insulating board to intercept heat transfer between the partitioned respective cooking regions; and a shock-absorbing unit to elastically support the insulating board in order to prevent damage to the insulating board.

2. The member according to claim 1, wherein the shock-absorbing unit includes springs to elastically support upper and lower portions of the insulating board.

3. The member according to claim 2, wherein the shock-absorbing unit further includes a holder to supportably surround an edge of the insulating board, and wherein the springs are disposed at upper and lower sides of the holder.

4. The member according to claim 3, wherein an elastic cushion is interposed between the insulating board and the holder.

5. The member according to claim 1, further comprising:

at least one auxiliary insulator provided at at least one of the upper and lower sides of the insulating board.

6. An electric oven comprising:

a cooking chamber for accommodating food to be cooked;

a partition member to partition the cooking chamber into two cooking regions;

an insulating board incorporated in the partition member to intercept heat transfer between the partitioned respective cooking regions; and a shock-absorbing unit incorporated in the partition member to elastically support the insulating board in order to prevent damage to the insulating board.

7. The oven according to claim 6, wherein the partition member includes upper and lower plates spaced apart from each other by a predetermined distance, and wherein the insulating board is interposed between the upper and lower plates.

8. The oven according to claim 7, wherein the shock-absorbing unit includes springs to support upper and lower sides of the insulating board.

9. The oven according to claim 8, wherein the shock-absorbing unit further includes a holder surrounding an edge of the insulating board, and wherein the springs are disposed between the upper plate and the holder and between the lower plate and the holder.

10. The oven according to claim 9, wherein an elastic cushion is interposed between the insulating board and the holder.

11. The oven according to claim 6, wherein the partition member further includes at least one auxiliary insulator provided at at least one of the upper and lower sides of the insulating board.

12. The oven according to claim 6, wherein the partition member is detachably mounted in the cooking chamber.

13. The oven according to claim 6, further comprising:

a plurality of convection modules adapted to heat the partitioned respective cooking regions in an individual fashion.

14. The oven according to claim 13, wherein each convection module comprises:

a convection heater;

a convection fan for creating a flow of air circulating around the convection heater and through the cooking chamber; and a fan motor for driving the convection fan.

* * * * *